US009790750B1

(12) United States Patent
Stoldt et al.

(10) Patent No.: US 9,790,750 B1
(45) Date of Patent: Oct. 17, 2017

(54) HANDLING TOOL WITH INTEGRATED SENSOR FOR REAL TIME MONITORING DURING OPERATION

(71) Applicant: FORUM US, INC., Houston, TX (US)

(72) Inventors: Frederik Stoldt, Hamburg (DE); Andre Vierke, Hamburg (DE)

(73) Assignee: FORUM US, INC, Houston, TX (US)

( * ) Notice: Subject to any disclaimer, the term of this patent is extended or adjusted under 35 U.S.C. 154(b) by 0 days.

(21) Appl. No.: 15/342,707

(22) Filed: Nov. 3, 2016

(51) Int. Cl.
*E21B 19/06* (2006.01)

(52) U.S. Cl.
CPC ..... *E21B 19/06* (2013.01)

(58) Field of Classification Search
CPC ..... E21B 19/06; E21B 19/07; E21B 19/10; B66C 1/48; B25J 13/081; B25J 13/082; B25J 13/083; B25J 13/084
USPC ..... 294/86.1, 194, 90, 102.1, 102.2
See application file for complete search history.

(56) References Cited

U.S. PATENT DOCUMENTS

| | | | | |
|---|---|---|---|---|
| 5,340,182 | A * | 8/1994 | Businк ..... | E21B 19/07 294/102.2 |
| 8,286,509 | B2 * | 10/2012 | Igarashi ..... | B25J 13/084 73/862.627 |
| 8,651,175 | B2 | 2/2014 | Fallen | |
| 9,372,075 | B2 | 6/2016 | Oudovikine | |
| 2013/0035787 | A1 | 2/2013 | Canter | |
| 2015/0122490 | A1 * | 5/2015 | Greening ..... | E21B 21/08 166/250.01 |
| 2015/0226022 | A1 * | 8/2015 | Angelle ..... | E21B 19/24 166/85.5 |
| 2016/0061022 | A1 | 3/2016 | McCoy | |
| 2016/0290073 | A1 * | 10/2016 | Zheng ..... | E21B 19/10 |

* cited by examiner

*Primary Examiner* — Dean Kramer
(74) *Attorney, Agent, or Firm* — Patterson & Sheridan, L.L.P.

(57) ABSTRACT

A handling tool is disclosed that includes a body having a high-stress location, a pocket formed in the high stress location, and a sensor adhered to a surface of the pocket and oriented along an axis of the body. The high stress location may be in a hinged plate of the body, a door latch of the body, and/or adjacent an ear of the body.

24 Claims, 3 Drawing Sheets

HANDLING TOOL WITH INTEGRATED SENSOR FOR REAL TIME MONITORING DURING OPERATION

BACKGROUND

Field

Embodiments disclosed herein generally relate to sensors integrated in or on tools and configured to provide real-time stress, strain, load, and/or fatigue measurements during operation of the tools.

Description of the Related Art

Handling tools utilized in oil and gas operations are subjected to very rough conditions. These handling tools carry heavy loads (tubulars and/or support equipment for example) high above personnel on a rig such that fatigue of these handling tools is a safety risk. These handling tools are inspected at certain times to determine fatigue, and only during these inspections can a dangerous or potentially dangerous problem, such as a crack in the handling tool, be detected.

Therefore there is a need for a method and apparatus that provides real-time monitoring of stress and strain that lead to fatigue of handling tools.

SUMMARY

In one embodiment, a handling tool includes a body having a high-stress location, a pocket formed in the high stress location, and a sensor adhered to a surface of the pocket and oriented along an axis of the body.

BRIEF DESCRIPTION OF THE DRAWINGS

So that the manner in which the above-recited features of the disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

Embodiments disclosed herein relate to measuring stress, strain, and load that cause fatigue of a handling tool utilized in oil and gas operations. The stress, strain, and load may be measured by sensors in or on the handling tool during operation. An exemplary handling tool is an elevator (or other similar tubular handling tools), which is generally a hinged device that is used to clamp around a tubular (e.g. drill pipe or casing) to facilitate lifting, conveying, and lowering of a single tubular or a string of tubulars. Embodiments of the disclosure, however, may be utilized in other handling tools as well as other machinery that experiences high stress, strain, and loading during operation.

Figure 1A:
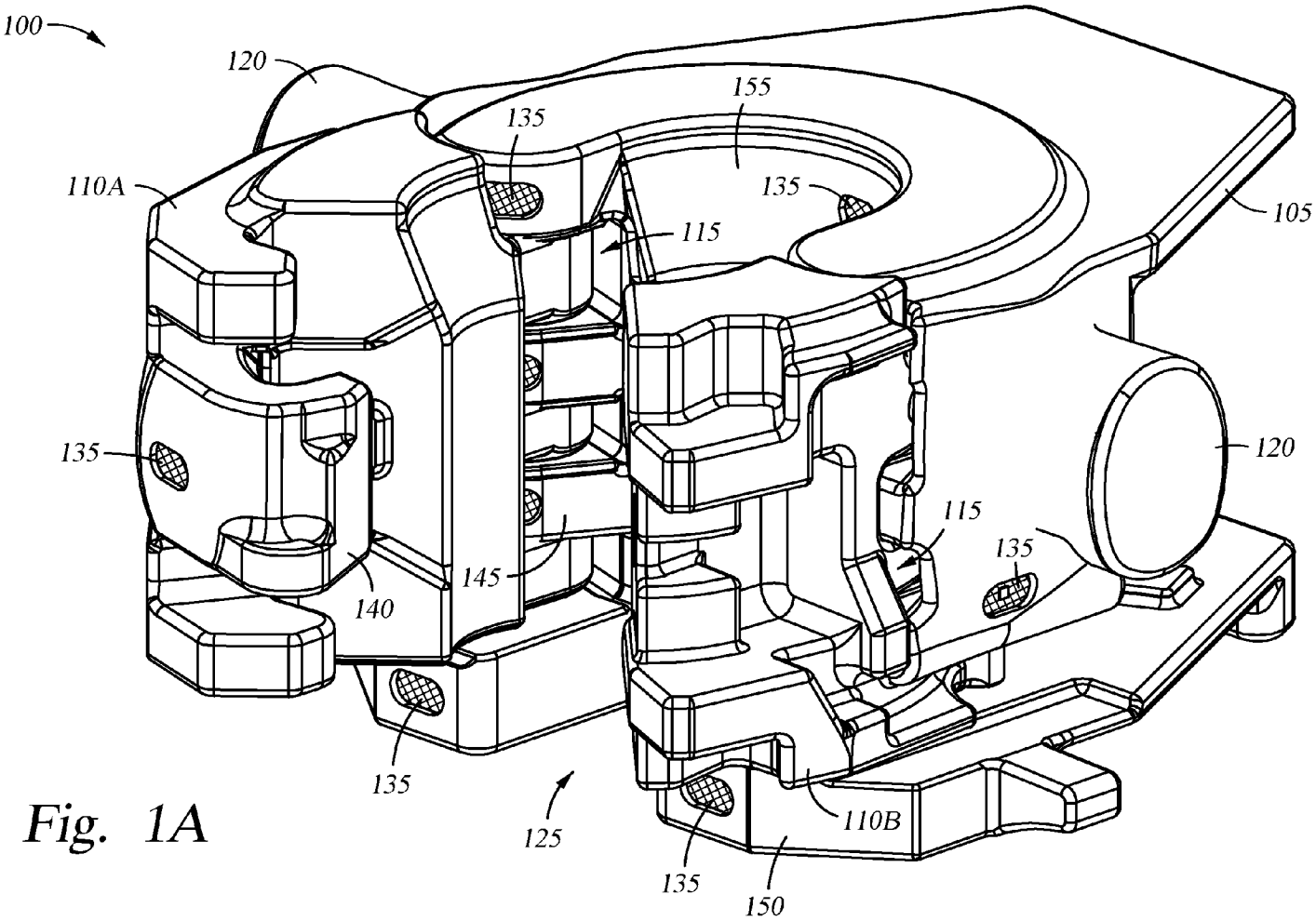
FIGS. 1A and 1B are isometric views of an elevator in an open and closed position, respectively, according to one embodiment.
Figure 1B:
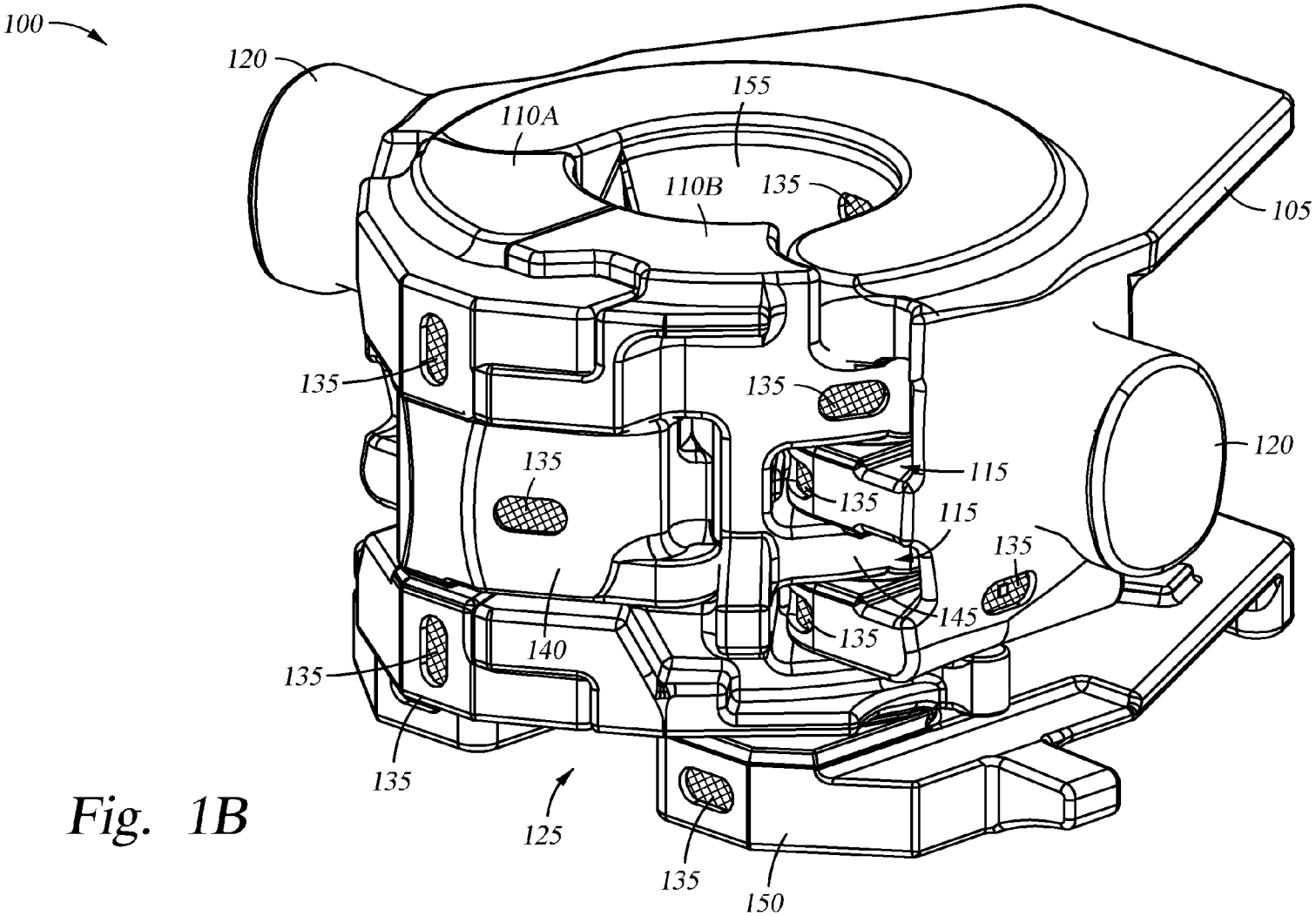

FIGS. 1A and 1B are isometric views of an elevator 100 in an open position and a closed position, respectively, according to one embodiment. The components of the elevator 100 may be formed out of a metallic material. The elevator 100 includes a main body member 105 having a plurality of hinged members 110A and 110B that are coupled to the main body member 105 at one end by a hinge device 115. The main body member 105 includes two ears 120 from which the elevator 100 may be suspended, such as by the bails of a travelling block.

The plurality of hinged members 110A and 110B may be configured as a door 125 that may be open as shown in FIG. 1A or closed as shown in FIG. 1B to define a center hole 155 within which a tubular or other tool may be clamped. Tubulars that may be supported by the elevator 100 include but are not limited to drill pipe, casing, tubing, and sucker rods that are utilized in an oil and gas operation. The door 125 may be selectively opened as shown in FIG. 1A to allow passage of the tubular or tool into and out of the center hole 155 of the elevator 100.

The elevator 100 includes one or more sensors 215 (illustrated in FIGS. 2A and 2B) located on or in high-stress locations 135 of the elevator 100. The high-stress locations 135 may be areas of the main body member 105 and/or the door 125 that experience high radial loading and/or high cross-axial loading. The high-stress locations 135 may include certain portions of the door 125, such as a latch 140 and/or hinge plates 145, as well as certain portions of the main body member 105, such as a base 150 and/or a wall of the center hole 155.

The sensors 215 may be one or more strain gauges, load cells, and/or other suitable devices that measure one or a combination of stress, strain, loading, and fatigue. Each of the sensors 215 may measure and/or monitor stress, strain, load, and/or fatigue along one axis, two axes, or three axes of the main body member 105 and/or the door 125.

Figure 2B:
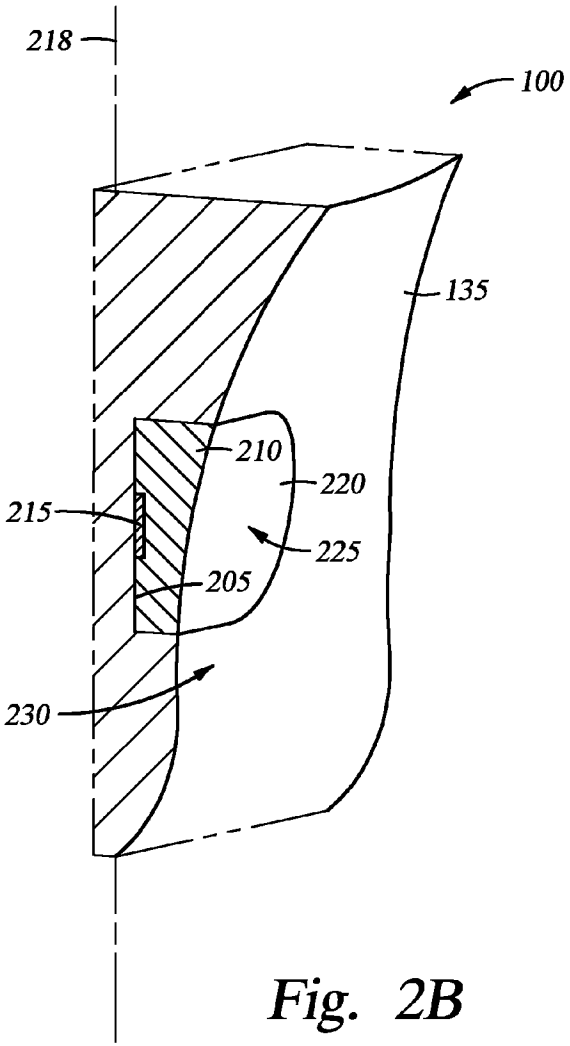
FIG. 2B is a cross-sectional view of the high-stress location of FIG. 2A.
Figure 2A:
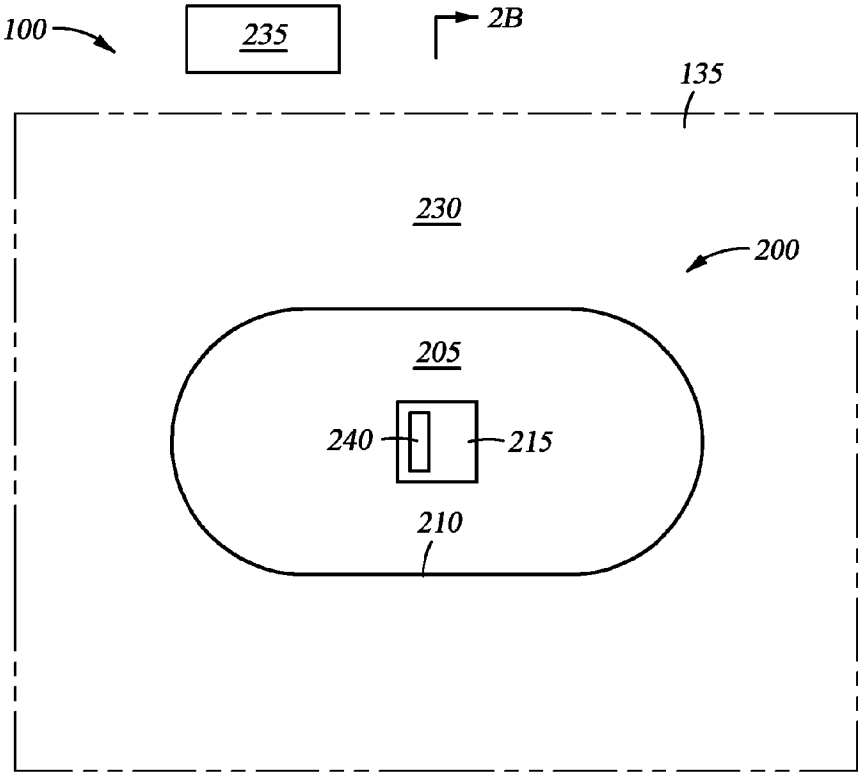
FIG. 2A is a front view of a portion of the elevator showing an exemplary high-stress location.

FIG. 2A is a front view of a portion of the elevator 100 of FIGS. 1A and 1B showing an exemplary high-stress location 135. FIG. 2B is a cross-sectional view of the high-stress location 135 of FIG. 2A.

The high-stress location 135 includes a pocket 200 formed in the main body member 105 and/or the door 125. The pocket 200 may include a bottom surface 205 and a sidewall 210. The pocket 200 may be machined into the main body member 105 and/or the door 125, or formed into the main body member 105 and/or the door 125 during fabrication of the elevator 100.

A sensor 215 may be placed in the pocket 200 to monitor stress and strain on or in the high-stress location 135. In one embodiment, the sensor 215 may include one or more strain gauges. In one embodiment, the sensor 215 may include one or more load cells. In one embodiment, the sensor 215 may utilize one or more electrical signals that change in magnitude in proportion to an amount of load being applied to the high-stress location 135.

A protective coating 220 (shown in FIG. 2B) may be placed over the sensor 215. The protective coating 220 may be a casting, epoxy, glue, or other material that at least partially covers the sensor 215. The protective coating 220 may substantially fill the pocket 200. The protective coating 220 may also include a surface 225 (shown in FIG. 2B) that includes a profile that matches a profile of a surface 230 of the high-stress location 135.

The sensor 215 may be attached to a surface of the pocket 200 by an adhesive, such as glue, which measures and/or monitors the load applied to the high-stress location 135 along at least one axis 218 (such as the longitudinal axis) of the main body member 105 and/or the door 125 that is to be measured and/or monitored. Typically up to three axes of the main body member 105 and/or the door 125 may be measured and/or monitored by one or more of the sensors 215.

The sensor 215 may be wired or wireless and provide real-time stress and strain measurements to one or more feedback units 235. The sensor 215 may include a transmitter/receiver unit 240 that may be queried periodically for a measurement to the feedback unit 235. Alternatively, the transmitter/receiver unit 240 may provide continuous stress and strain measurement data to the feedback unit 235.

The feedback unit 235 may include one or more gauges monitored by personnel and/or a computer that receives measurement data from the sensor 215. The feedback unit 235 may include preprogrammed values (such as maximum and minimum allowable limits) of stress and strain for the high-stress locations 135. The feedback unit 235 may be equipped with an audible and/or visible alarm when the measured data from the sensor 215 increases above or decreases below the preprogrammed values.

The sensor 215 and/or the feedback unit 235 may be utilized to measure and calculate data from each high-stress location 135, the data including stress, strain, magnitude of load, and/or life cycle of each high-stress location 135. In one embodiment, the feedback unit 235 may track the amount of load and the number of times such load was carried by the elevator 100. The load may include the weight of tubulars suspended by the elevator 100.

While the foregoing is directed to embodiments of the disclosure, other and further embodiments may be devised without departing from the basic scope thereof, and the scope thereof is determined by the claims that follow.

The invention claimed is:

1. A handling tool, comprising:

a body having a high-stress location, wherein the body comprises a plurality of hinged plates that are hinged to a main body member to form a door, and wherein the high stress location is in one of the hinged plates;

a pocket formed in the high stress location; and a sensor adhered to a surface of the pocket and oriented along an axis of the body.

2. The handling tool of claim 1, wherein the door is movable between an open position and a closed position.

3. The handling tool of claim 1, wherein the door includes a latch, and wherein the body has another high-stress location that is in the latch, another pocket formed in the high stress location in the latch, and another sensor adhered to a surface of the pocket in the latch that is oriented along the same or another axis of the body.

4. The handling tool of claim 1, wherein another high stress location is in the main body member, another pocket is formed in the high stress location in the main body member, and another sensor is adhered to a surface of the pocket in the main body member that is oriented along the same or another axis of the body.

5. The handling tool of claim 1, wherein the sensor comprises a transmitter/receiver unit.

6. The handling tool of claim 1, wherein the pocket comprises a protective coating covering the sensor.

7. The handling tool of claim 6, wherein the protective coating includes a surface having a profile that matches a profile of a surface of the high-stress location.

8. The handling tool of claim 1, wherein the sensor includes one or more strain gauges.

9. The handling tool of claim 1, wherein the sensor is configured to measure at least one of stress, strain, load, and fatigue applied to the high-stress location.

10. The handling tool of claim 1, wherein the sensor is configured to communicate data corresponding to stress and strain in the high stress location with a feedback unit.

11. A handling tool, comprising:

a body having a high stress location, wherein the body comprises a plurality of members that are hinged to a main body member to form a door, wherein the door includes a latch, and wherein the high stress location is in the latch;

a pocket formed in the high stress location; and a sensor adhered to a surface of the pocket and oriented along an axis of the body.

12. The handling tool of claim 11, wherein another high stress location is in one of the plurality of members, another pocket is formed in the high stress location in the one of the plurality of members, and another sensor is adhered to a surface of the pocket in the one of the plurality of members that is oriented along the same or another axis of the body.

13. The handling tool of claim 11, wherein another high stress location is in the main body member, another pocket is formed in the high stress location in the main body member, and another sensor is adhered to a surface of the pocket in the main body member that is oriented along the same or another axis of the body.

14. The handling tool of claim 11, wherein the pocket comprises a protective coating covering the sensor.

15. The handling tool of claim 14, wherein the protective coating includes a surface having a profile that matches a profile of a surface of the high stress location.

16. The handling tool of claim 11, wherein the sensor is configured to measure at least one of stress, strain, load, and fatigue applied to the high stress location.

17. The handling tool of claim 11, wherein the sensor is configured to communicate data corresponding to stress and strain in the high stress location with a feedback unit.

18. A handling tool, comprising:

a body having a high stress location, wherein the body comprises a plurality of members that are hinged to a main body member to form a door, wherein the main body member has a pair of ears from which the body can be suspended, and wherein the high stress location is in the main body member adjacent one of the ears;

a pocket formed in the high stress location; and a sensor adhered to a surface of the pocket and oriented along an axis of the body.

19. The handling tool of claim 18, wherein another high stress location is in one of the plurality of members, another pocket is formed in the high stress location in the one of the plurality of members, and another sensor is adhered to a surface of the pocket in the one of the plurality of members that is oriented along the same or another axis of the body.

20. The handling tool of claim 18, wherein the door includes a latch, and wherein another high stress location is in the latch, another pocket is formed in the high stress location in the latch, and another sensor is adhered to a surface of the pocket in the latch that is oriented along the same or another axis of the body.

21. The handling tool of claim 18, wherein the pocket comprises a protective coating covering the sensor.

22. The handling tool of claim 21, wherein the protective coating includes a surface having a profile that matches a profile of a surface of the high stress location.

23. The handling tool of claim 18, wherein the sensor is configured to measure at least one of stress, strain, load, and fatigue applied to the high stress location.

24. The handling tool of claim 18, wherein the sensor is configured to communicate data corresponding to stress and strain in the high stress location with a feedback unit.

* * * * *